United States Patent [19]

Schmidt et al.

[11] Patent Number: 5,015,131

[45] Date of Patent: May 14, 1991

[54] HITCH RETARDER

[75] Inventors: Kenneth D. Schmidt; Jan D. Holt, Both of St. Charles, Mo.

[73] Assignee: ACE Industries, Incorporated, Earth City, Mo.

[21] Appl. No.: 409,315

[22] Filed: Sep. 19, 1989

[51] Int. Cl.[5] ..... B60P 03/06

[52] U.S. Cl. ..... 410/63; 410/62

[58] Field of Search ..... 410/56, 59, 60, 61, 410/62, 63; 280/438.2, 425.1; 188/316

[56] References Cited

U.S. PATENT DOCUMENTS

| | | | |
|---|---|---|---|
| 1,185,754 | 6/1916 | Anderson | 188/317 |
| 2,723,847 | 11/1955 | Hogan | 188/317 |
| 2,994,442 | 8/1961 | Frederick | 188/271 |
| 3,143,978 | 8/1964 | Clejan | 410/60 |
| 3,167,288 | 1/1965 | Farabaugh . | |
| 3,225,707 | 12/1963 | Rollins et al. | 410/60 |
| 3,486,467 | 12/1969 | Coulson | 410/62 |

*Primary Examiner*—Sherman Basinger
*Assistant Examiner*—Virna L. Mojica
*Attorney, Agent, or Firm*—Polster, Polster and Lucchesi

[57] ABSTRACT

A retarder (97) for a railcar hitch (1) is disclosed. The hitch has an erected and a retracted position and the retarder slows movement of the hitch towards its retracted position. The retarder comprises a cylinder (99) fixedly mounted on a railcar. A piston (101) is movable in the cylinder. A rod (115) attaches the piston to the movable hitch element so that preferably only axial loads act on the piston during operation of the hitch. The fluid compressed in one end of the cylinder by the piston is bled (metered) from the one end of the cylinder so as to control the rate of movement of the movable element during hitch retraction.

21 Claims, 4 Drawing Sheets

HITCH RETARDER

BACKGROUND OF THE INVENTION

This invention relates to retractable trailer hitches for railroad cars used to transport over-the-road trailers, and, more particularly, to a retarder for slowing the movement of such a hitch toward its retracted position.

Trailer hitches for intermodal railway cars are well known in the art. They are used on 'piggy back' intermodal railcars to secure over-the-road trailers on the railcar. Of late, railroads have created facilities for handling intermodal shipments. There, trailers are lifted on and off the car using either a bridge crane straddling the track, or a large fork lift. In certain applications, and to give shippers greater flexibility, certain intermodal cars are capable of handling large shipping containers as well as over-the-road trailers. Since the railcar has this dual use capability, the trailer hitch must be retractable so as not to interfere with a container when the railcar is used to transport containers. These conventional hitches are manually raised either through use of a operated screw jack mechanism, or by a crane which lifts the retracted hitch.

Typically, a retractable hitch includes a first or generally vertical strut and a second or diagonal strut. The upper ends of the struts are pivotally connected to a hitch head which serves as a fifth wheel. The head supports the front end of a trailer and positively holds it on the railcar. The hitch head has releasable jaws which positively engage the king pin of the trailer. At the destination, the hitch head is operated to release the kingpin and thereby permit the trailer to be off-loaded.

Besides manually operable or crane operable retractable hitches such as described above, another commonly known hitch is a tractor operated hitch. In a well recognized alternative to employing a crane or other lifting equipment to load and off-load trailers from an intermodal railway car, a "circus" loading/off-loading technique is used. A trailer coupled to a tractor is driven lengthwise onto the railcars, and from one car to another, until reaching a desired position. The tractor engages a retracted hitch on the car, raises it, and transfers the trailer from the tractor to the raised hitch. During off-loading, the tractor actuates a retraction mechanism for the hitch and transfers the trailer from the hitch to the tractor while the hitch moves to its retracted position. Various crane operated, and tractor operated hitches and hitch heads are shown in U.S. Pat. Nos. 4,185,564, 4,193,350, 4,216,726, 4,221,397, 4,225,276, 4,230,430, 4,230,431, 4,239,429, 4,264,250, 4,397,594, 4,407,617, and 4,563,117.

In recent years, an intermodal railcar has been developed which is known as a "spine-type" car. This car has a center through sill beam running the length of the car. The car also has intermittent platforms at its sides for supporting the wheels of an over-the-road trailer. A hitch is provided on the spine structure for supporting the forward end of the trailer. Typically, each intermodal spine-type car carries five (5 over-the-round trailers. Because these spine-type cars are also used to carry containers, the hitch must be retractable.

As part of this invention, a manually operable release mechanism is provided to retract a hitch. The mechanism is operated by a train attendant standing next to the car. With the release mechanism actuated, the hitch is enabled to move to its retracted position under gravity bias. Because these hitches are heavy (e.g., 1500 lbs. or more), it will rapidly move to its retracted position with great force. The hitches, as they are falling, can cause physical injury to a train attendant who is not clear of the hitch. The impact of the hitch may also damage the railcar or possibly the hitch itself during its falling movement.

SUMMARY OF THE INVENTION

Among the several objects and features of the present invention may be noted the provision of a retractable trailer hitch for use on a dual use intermodal railroad car which enables the car to readily transport both over-the-road trailers and shipping containers;

The provision of such a hitch in which its retraction is retarded (slowed) a sufficient amount to allow sufficient time for railcar personnel to move clear of the hitch during its retraction movement;

The provision of such a hitch which is movable to its retracted position under its own weight;

The provision of such a hitch which is easily retracted by personnel standing on the ground away from the hitch;

The provision of such a hitch which is retractible from either side of the railcar;

The provision of such a hitch in which working components of the hitch are covered to prevent personnel from inadvertently coming into contact therewith during movement of the hitch; and The provision of such a hitch which is reliably operable over a wide extreme of weather conditions, which is of rugged construction, and which has a long service life.

Briefly stated, a retarder of the present invention is for use with a railcar hitch, the latter having an erected and a retracted position. The retarder slows movement of the hitch toward its retracted position. The retarder comprises a cylinder fixedly mounted to the railcar and a piston is movable axially in the cylinder between an erected position when the hitch is in its erect position and a retracted position when the hitch is in its retracted position so as to compress a fluid within the cylinder. The piston is attached to the movable hitch such that substantially only axial loads are placed on the piston during retraction of the hitch. Compression of fluid in the cylinder by the piston is regulated so as to control the rate of movement of the hitch as the hitch moves toward its retracted position. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
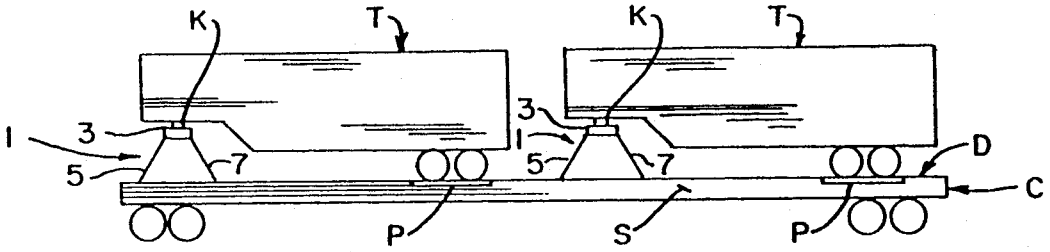
FIG. 1 is a representation of a railcar for transporting trailers and illustrates two hitches of the present invention installed thereon.

Referring to the drawings, a retractable trailer hitch of the present invention is indicated generally at 1. As shown in FIG. 1, hitch 1 is for use on an intermodal railroad car C of a type used to transport over-the-road trailers T. Car C is a "spinep" type railcar having an elongate center through sill or beam S extending lengthwise of the car and having an upper surface constituting a deck D. Car C is sufficiently long such that multiple (e.g., 5) trailers T are transportable on the car, the front of each trailer being supported by a respective hitch 1. As shown in FIG. 1, only two trailers T are shown on car C. On opposite sides of the center through sill S, intermittent platforms P are provided for supporting to wheels of trailers T. As is well known in the art, trailers T are preferably hoisted onto car C so that their wheels rest on platforms P and so that the front of the trailer is supported on a respective hitch 1. However, within the broader aspects of this invention, those skilled in the art will recognize that hitches 1 of the present invention may be utilized with drive on-drive off intermodal railcars as well.

Hitches 1 are preferably erected prior to loading trailers on the car. The hitches have a hitch head 3 used to capture and hold a king-pin K of the trailer and to support the front of the trailer during its transport. At its destination, the king-pin is released and the trailers off-loaded. With respect to the erection of a railcar hitch, reference may be made to the co-assigned U.S. Pat. No. 4,264,250 which is incorporated herein by reference. With respect to the design of hitch heads for capturing and holding the king-pin of a trailer, reference may be made to the following co-assigned U.S. Pat. Nos. 4,563,117, 4,397,594, 4,221,397, and 4,193,350 all of Which are also incorporated herein by reference.

Figure 2:
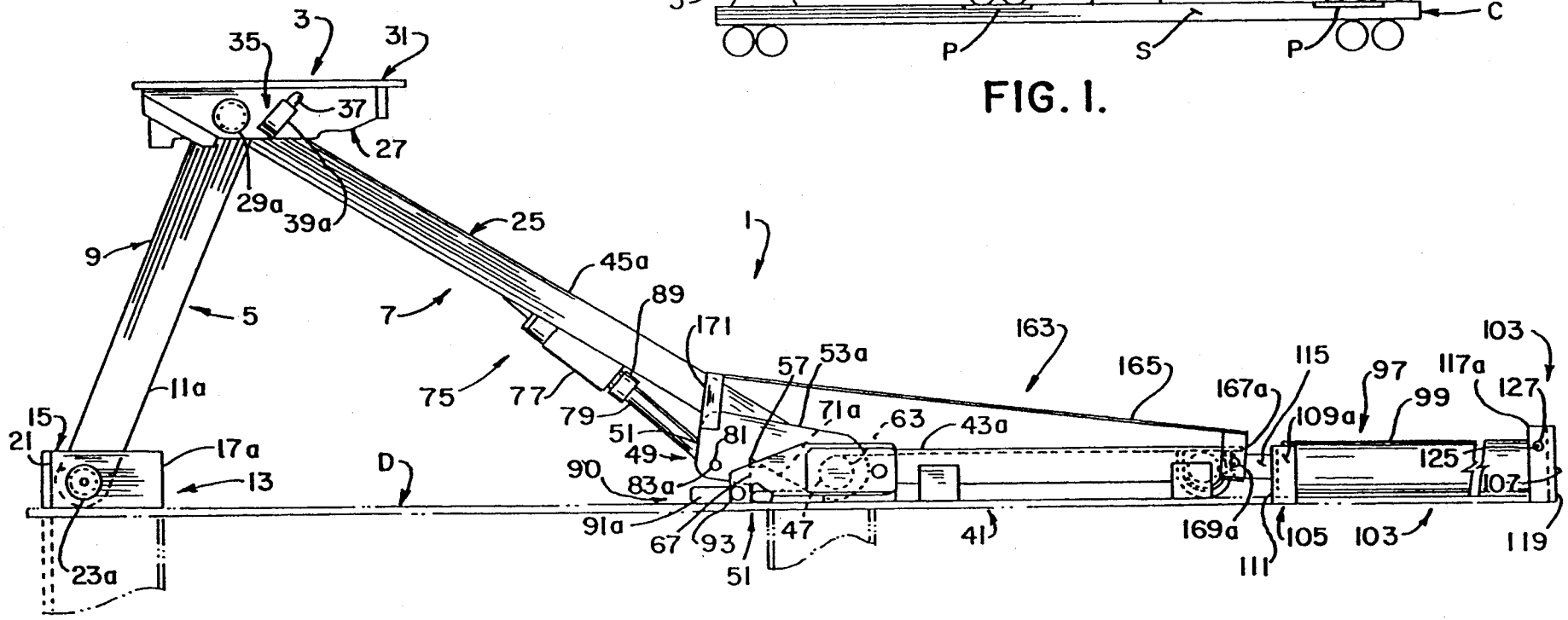
FIG. 2 is a side elevational view of the hitch in its erect position.

Referring to FIG. 2, hitch 1, whose components are axially aligned with the longitudinal centerline of car C, includes a first support means 5 and a second support means 7 for supporting hitch head 3. Means 5 comprises a generally vertical strut 9, one end of which is pivotally mounted to deck D of railcar C. Strut 9 has a pair of parallel, spaced apart legs 11*a* and 11*b*. Respective ends of each leg are received in a mounting means 13 which comprises a lug assembly 15. The lug assembly is attached to deck D and aligned so as to permit pivotal movement of the first support means about an axis perpendicular to the longitudinal axis of the railcar as hitch 1 is moved between its erected and retracted positions. The lower end of each strut leg 11*a*, 11*b* received in lug assembly 15 is fitted in a pocket formed by a sidewall 17*a*, 17*b*, respectively, of the lug assembly and a bracket 19*a*, 19 b, respectively, which extends rearwardly from and perpendicular to a front plate 21 of the lug assembly. A respective strut pin 23*a*, 23*b* extends through corresponding openings in the sidewall, strut leg and bracket to pivotally mount strut 9 to the deck so the strut can be raised and lowered.

Figure 5:
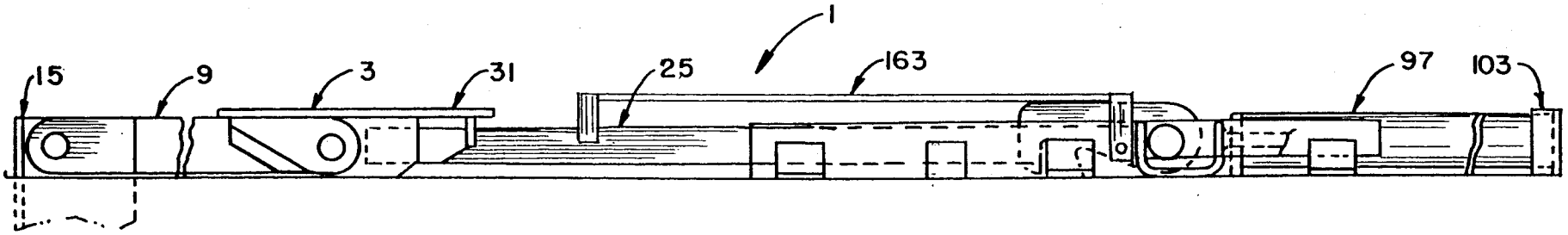
FIG. 5 is a side elevational view of the hitch in its fully retracted position.

Second support means 7 comprises a diagonal strut 25, one end of which is translatable in a horizontal direction over the deck and which is pivotal about a transverse, horizontal axis as it is translated longitudinally of the car between a first or hitch erect position (i.e., the FIG. 2 position) and a second or hitch retracted position (i.e., see FIG. 5). As shown in FIG. 2, strut 9 is generally vertical (but leans somewhat toward diagonal strut 25) when the hitch is in its erect position and strut 25 extends generally diagonally between the upper end of strut 9 and the deck when the hitch is erect.

Figure 3:
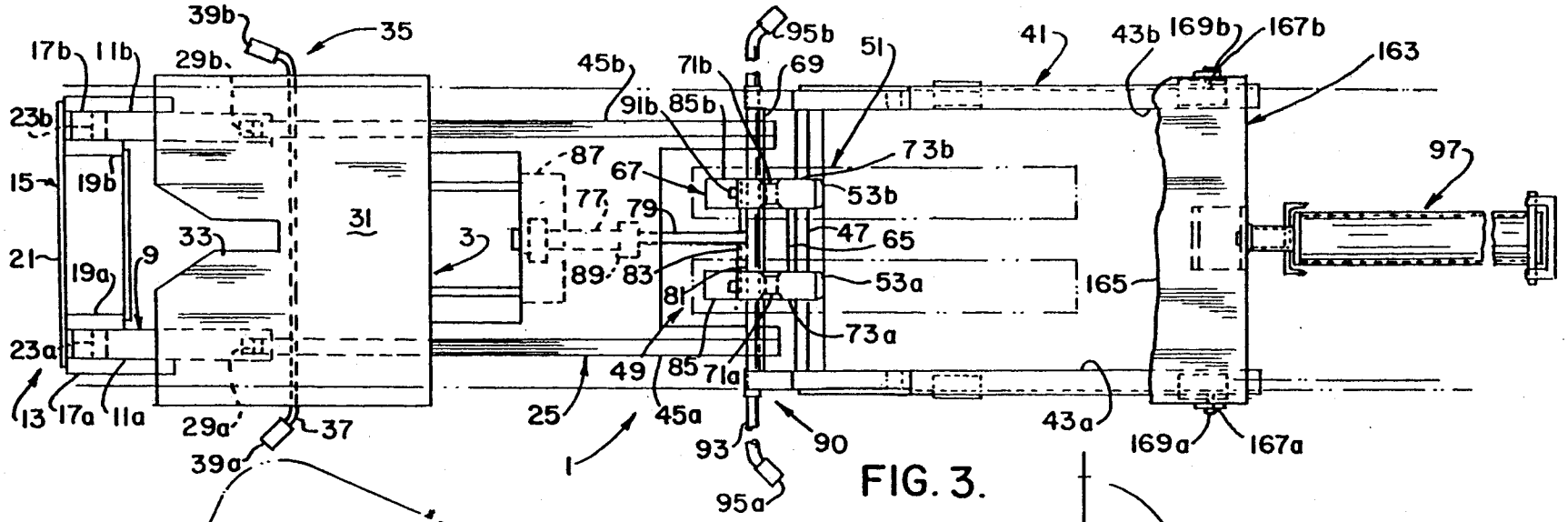
FIG. 3 is a top plan view of the hitch in its erect position.

Hitch head 3 is commonly pivotally carried on the respective opposite ends of struts 9 and 25 and, as noted, is elevated a required distance above deck D when the hitch is erect. Since the hitch head structure is fully described in the above mentioned patents incorporated herein by reference and is commercially available from the assignee of the present invention under its trade designation Model 6, the construction of the hitch head will not be given in detail. The hitch head does include a head weldment 27 which is pivotally connected to the upper ends of struts 9 and 25 by respective strut pins 29*a*, 29*b*. The weldment includes a top plate 31 having a notch 33 (see FIG. 3) extending rearwardly from the front of the weldment. The notch receives king-pin K (see FIG. 1). Hitch head 3 has operable and closable jaws (not shown) which grip king-pin K to hold trailer T in place during movement of the railcar. A handle assembly 35 includes a rod 37 extending crosswise of the weldment beneath plate 31. The rod projects outwardly beyond both sides of the hitch head and is downwardly turned at its respective outer ends. A socket 39*a*, 39*b* is formed at each outer end of the rod for rail yard personnel to insert a tool (not shown) in either socket. By rotating rod 37 with the tool, the king-pin jaws are released to permit off loading of the trailer from the railcar. It will be appreciated that the king-pin may be released by turning rod 37 from either side of the railcar.

With respect to strut 25, a guide assembly 41 has parallel, spaced apart guide rails 43*a*, 43*b*, respectively, extending parallel to the longitudinal axis of the car. The rails are each mounted on deck D and are of an inverted L configuration when installed. Strut 25, like strut 9, has a pair of parallel spaced apart legs 45*a* and 45*b*. A guide pin 47 extends between these legs and projects outwardly beyond them. The ends of guide pin 47 are received in the respective guide rails 43*a*, 43*b* and permit horizontal, axial translation movement of the lower end of strut 25 between the hitch erect and the hitch retracted positions.

Hitch 1 includes a locking means 49 for locking diagonal strut 25 and hitch 1 in the hitch erect position. Means 49 includes a hook assembly 51 comprising a pair of plates 53*a* and 53*b*, respectively. The plates are identical in construction. Each has a leading edge 55 which is curved at its lower end. Intermediate the length of each of the plates 53*a*, 53*b*, a notch 57 is formed which extends upwardly from the base of the plate. The forward edge 59 of the notch rises vertically from the base of the plate, while its trailing edge 61 slopes rearwardly. At the rear of each plate is a transverse bore 63 for the plates to be mounted on pin 47 between the legs of strut 25. A plate 65 extends between the respective inner walls of the plates and is secured to each, as, for example, by welding.

Locking means 49 further includes a latch lug 67 which is mounted to the deck D of the railcar. The latch lug has a base plate 69 which extends between the guide rails at the forward end thereof. A pair of upwardly extending, generally triangularly shaped latch members 71*a*, 71*b* are secured to the top of base plate 69. The spacing of the members on the plate corresponds to that of latch plates 53a, 53b. The shape of the latch members 71a, 71b corresponds generally to the shape of the notches 57 formed in the plates 53a, 53b, except the upper end of each latch member is truncated. The rear face 73a, 73b of each latch members 71a, 71b thus forms a ramp up which the leading edge of the respective plates are drawn as the hitch is erected. When forward movement of strut 25 pulls hook assembly 51 over base 69, the notches in plates 53a, 53b are captured by the respective latch members.

A bias means 75 acts to bias latch hook plates 53a, 53b toward their latched positions thereby to maintain hitch 1 in its hitch erect position. The bias means includes a compression spring 77 which is mounted on a bar 79. The lower end of the bar (as shown in FIG. 2) fits between plates 53a, 53b of hook assembly 51. A pin 81 is inserted through a sleeve 83 at the base of the bar and the ends of the pin are received in corresponding openings 85a, 85b, respectively, in plates 53a, 53b. The upper end of the bar is attached to a clevis assembly 87 which, in turn, is attached to legs 45a, 45b of strut 25. One end of spring 77 bears against the clevis assembly, while the other end of the spring bears against an annular seat 89 formed on the bar. The spring force is transmitted to plates 53a, 53b to urge the plates rearwardly and downwardly against the latch members thereby to prevent unlocking of the hitch in service.

Figure 6:
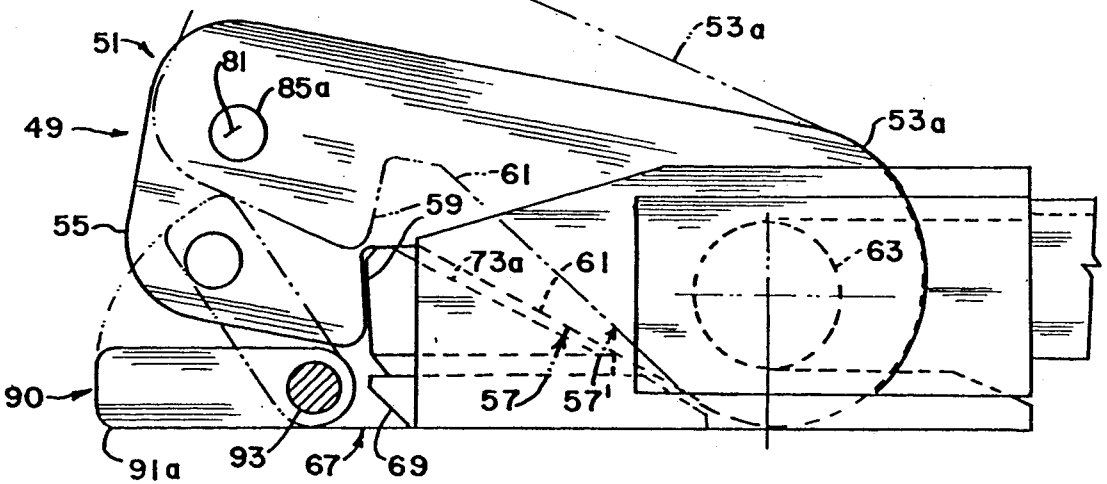
FIG. 6 is a side elevational view of the latching and release mechanism for the hitch.

The hitch, as noted, is maintained in its erect position during transport of a trailer from its origin to its destination. Once there, and after the trailer has been offloaded, hitch 1 may be retracted to its position shown in FIG. 5. For this purpose, the hitch includes a manually operable means 90. Means 90 includes a pair of cams 91a, 91b, respectively, each of which is attached to a release rod 93. Rod 93 extends transversely of the railcar and is pivotally mounted to the railcar deck D. As shown in FIG. 6, the rod is mounted forward of base plate 69 and the cams are positioned on the shaft so to be immediately below the respective plates 53a, 53b. The length of rod 93 is such that the ends of the rod extend beyond the sides of the hitch. The ends of the rod are bent and terminate in respective sockets 95a, 95b. A yardman standing on the track bed adjacent railcar C can readily insert a tool in either socket and rotate the rod. Clockwise rotation of the rod, as viewed in FIG. 6, moves the cams against the forward end of their associated plates 53a, 53b to lift the plate and also aids rearward movement of the lower end of diagonal strut 25 upon initiation of retraction of the hitch. When the bottom edge of the plates clear the top of the latch members, retraction of the hitch commences.

Given the weight of hitch 1, which is approximately 1,500 pounds, it is desirable that the hitch not retract instantaneously upon the release of plates 53a, 53b. Rather, retraction of the hitch should take place over a reasonable amount of time so as to permit personnel to move clear of the hitch and so as to prevent damage to the hitch. For this purpose, a retarder 97 is provided with the hitch. Retarder 97 comprises a cylinder 99 in which a piston 101 is movable. The cylinder is fixedly mounted to the deck of the railcar and the piston is attached to strut 25 for movement of the piston with the strut.

Figure 7:
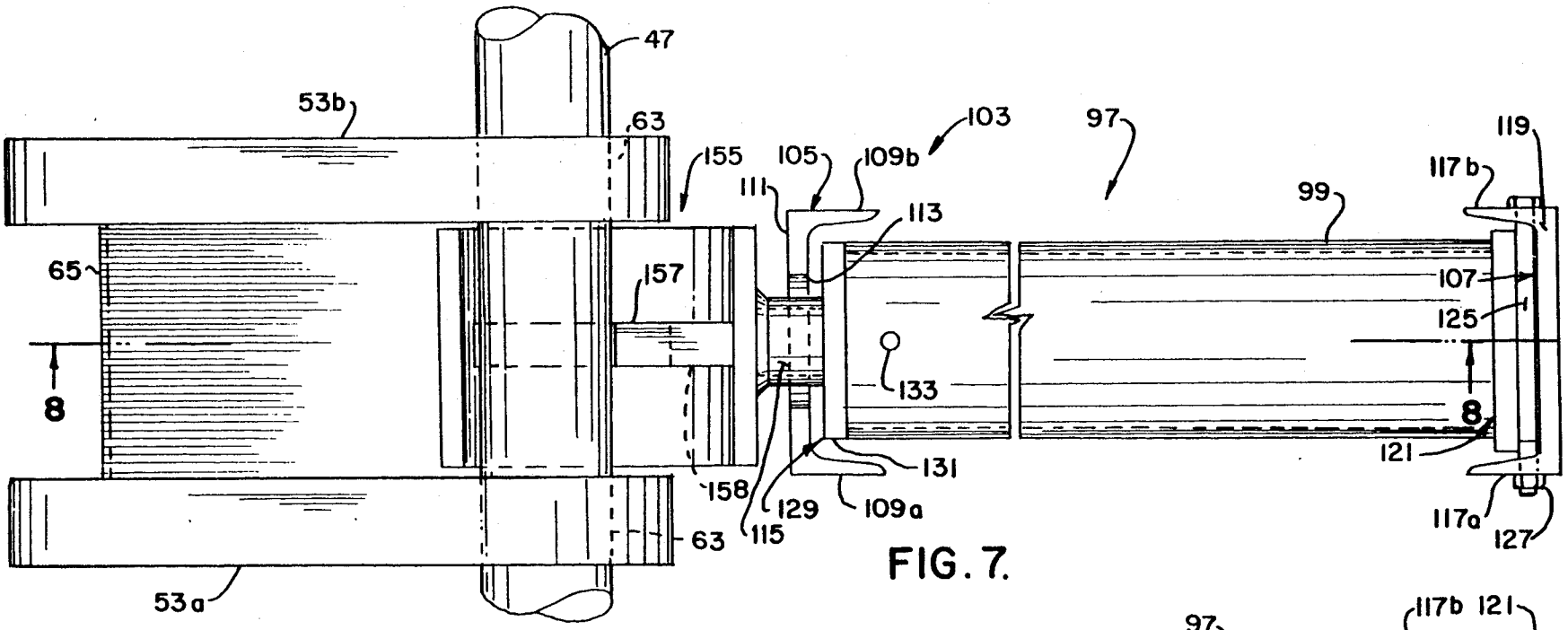
FIG. 7 is a top plan view of a hitch retarder.
Figure 8:
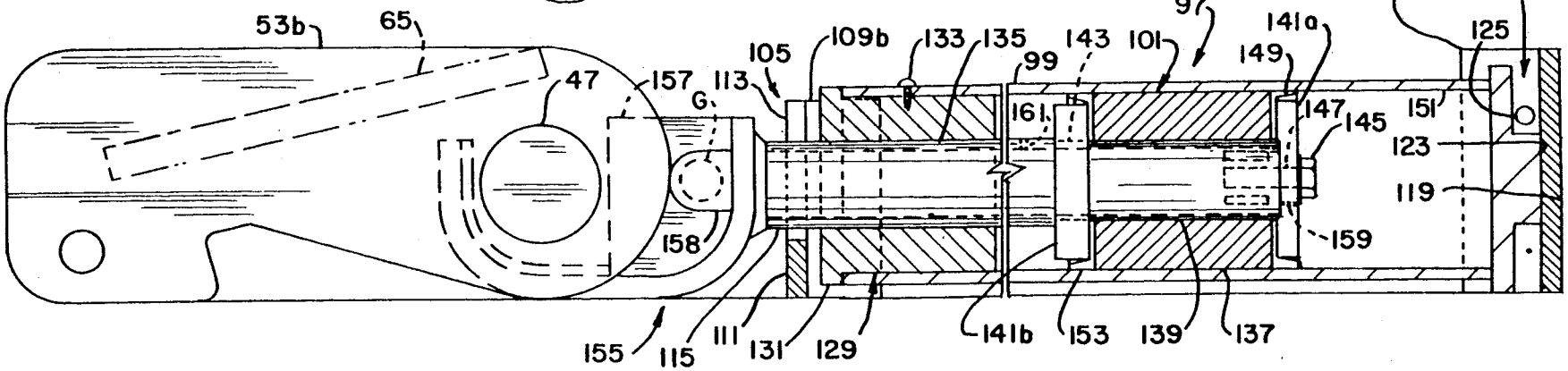
FIG. 8 is a sectional view taken along line 8—8 in FIG. 7.

Referring to FIGS. 7 and 8, retarder cylinder 99 is axially mounted along the longitudinal centerline of the railcar deck D. A support means 103 for the retarder cylinder includes a forward support 105 and a rear support 107. Support 105 is U-shaped in plan having rearwardly extending side walls 109a, 109b, and an end wall 111. A notch 113 extends downwardly from the upper end of wall 111 to provide an aperture through which a piston rod 115 extends. Support 107 is also U-shaped in plan having forwardly extending side walls 117a, 117b, and an end wall 119. A cap 121 fits over the end of cylinder 99 adjacent support 107. The cap has a boss 123 on its outer face which bears against the inner face of end wall 119 for transferring axial loads to which the retarder is subjected. A bolt 125 extends between side walls 117a, 117b at a immediately point above the boss to capture the cylinder in place and prevent any upward dislodging movement of the retarder doing hitch operation. A nut 127 secures the bolt in place.

The other end of cylinder 99 is sealed by a cap 129 having an outer circumferential flange 131 fitting over the end wall of the cylinder. A screw 133 attaches the cylinder and cap. The cap has a central, longitudinal bore 135 sized to accommodate rod 115. Piston 101 comprises a wear bearing 137 having a central, longitudinal bore 139 through which the inner end of the rod extends. End plates 141a, 141b fit over the respective ends of the wear bearing and plate 141b has a central opening 143 through which the rod fits. The inner end of the rod abuts the inner face of end plate 141a and the end of the rod is threaded for a screw 145 to be threaded through an opening 147 in the end plate and attach the end plate to the rod. A fluid seal 149 is sandwiched between plate 141a and the piston. The seal forms a fluid seal between the piston and the inner wall 151 of cylinder 99. Wall 151 is preferably of an extruded material and a second seal 153 is sandwiched between plate 141b and the piston, at the other end of the piston, to wipe down the cylinder wall and keep the bore of the cylinder clean as the piston reciprocates in the cylinder.

The outer end of rod 115 is attached to one end of a U-shaped hook 155 by which the retarder is connected to pin 47 of strut 25. The width of the hook is less than the distance between the inner faces of plates 53a, 53b, for the hook to fit between the plates on the pin. Thus, piston 101 is movable back and forth in a horizontal direction as the strut moves to erect and retract hitch 1. An upstanding rib 157 extends forwardly from the inner face of the rear wall of the hook. The length of the rib is such as to leave a gap between the forward end of the rib and the inner face of the front wall of the hook which is slightly greater than the diameter of pin 47. This allows the pin to fit in the hook between the rib and forward wall of the hook. A horizontal slot 159 in rib 157 extends approximately one-half the length of the rib. The centerline of the slot corresponds to that of rod 115 and the height of the slot is sufficient for a tool such as a gag bar G (see FIG. 8) to be inserted between rails 43a, 43b, through the slot. The gag bar is used when the hitch is being serviced and prevents movement of strut 25 during such service. Upon completion of service, the gag bar is removed.

Figure 9:
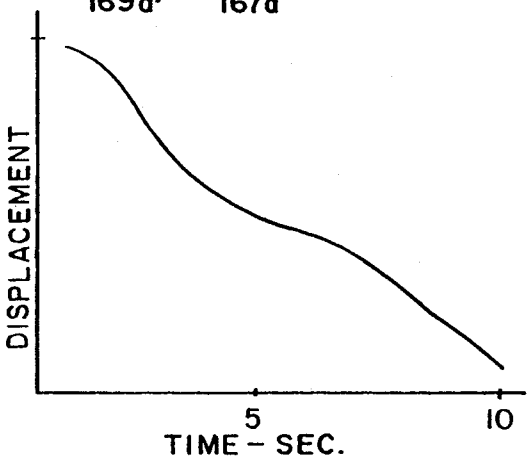
FIG. 9 is a graph illustrating the retraction rate of the hitch using the retarder.
Figure 4:
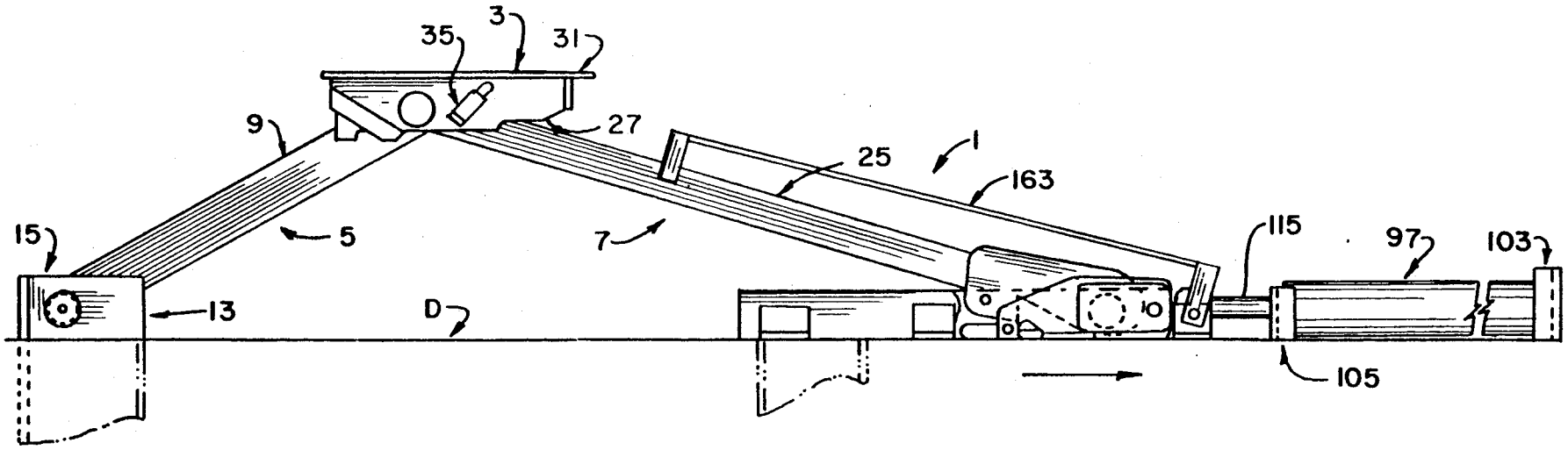
FIG. 4 is a side elevational view of the hitch in a partially retracted position.

Rod 115 is hollow, and a first bleed hole 159 is formed in the inner end of the rod where it attaches to end plate 141a. A second bleed hole 161 extends through the side wall of the rod at a point adjacent the opposite end of piston 99. The diameter of the bleed holes is such as to bleed or meter the fluid (air) compressed by piston 101 from within the cylinder at a controlled or regulated rate thereby to determine the retraction time imposed on hitch 1 by the retarder. Referring to FIG. 9, the retraction of the hitch versus time is plotted. With hitch 1 erected, rod 115 is pulled fully to the left as viewed in FIG. 1. Upon disengagement of plates 53*a*, 53*b*, from latch members 71*a*, 71*b* as previously described, the weight of the struts and hitch head forces piston I15 to the right as viewed in these drawings. Movement of piston 99 compresses air in the cylinder until the pressure counteracts the force on the piston created by the weight of the hitch. At that point, there is a pause in the retractive movement of the hitch. The compressed air in the end of the cylinder now bleeds out through holes 159 and 161. When sufficient air has bled, the weight of the hitch components again causes retractive movement of the hitch. The intermediate point in hitch retraction is shown in FIG. 4, and that point corresponds to the "knee" in the graph of FIG. 9.

More specifically, due to the geometry of hitch 1, initially the weight of the hitch applies only a small force to piston rod 115. As the hitch retracts air pressure in the expansible cylinder rapidly increases and substantially counterbalances the weight of the hitch. Air bleeds from the expansible chamber via bleed holes 159 and 161 at a metered rate thereby to release air pressure which permits further downward movement of the hitch toward its retracted position. Further, due to the toggle geometry of hitch 1, as the hitch approaches its fully retracted position (as shown in FIG. 5), very high axial compression forces are transmitted to piston 101 via the lower end of strut 25 and piston rod 115. However, the compressed air in cylinder 99 is more than sufficient to counter these loads and the bleeding (metering) of the compressed air via bleed holes 159 and 161 permits full retraction of the hitch. Preferably, using retarder 97 of the present invention, a desired minimum retraction time for the hitch of approximately 3 seconds, and preferably a retraction time of between 5–9 seconds. Of course, those skilled in the art will recognize that by varying the diameter of metering bleed holes 159 and 161, and by changing the kinematic linkages of hitch 1, the amount of retardation and the shape of FIG. 9 may be varied.

To protect the latching components of the hitch from structural damage and to keep personnel clear of the hitch and retarder as the hitch is raised and lowered, a cover 163 overlying the retarder is provided. The cover comprises a rectangular plate 165 whose width corresponds generally to that of strut 25. The plate is pivotally attached to side rails 43*a*, 43*b* at a point adjacent the rear end of strut 25 when the hitch is retracted. Tabs 167*a*, 167*b* respectively extend downwardly from the sides of the plate at the rear end thereof. The tabs are attached to the outer face of the respective side rails by pins 169*a*, 169*b*. A length of the plate corresponds to the distance between the end of the strut when the hitch is retracted and the forward end of plates 53*a*, 53*b*. A second pair of tabs 171, only one of which is shown in the drawings, extend downwardly from the side of the plate at his forward end and serve to maintain the plate in its proper position relative to strut 25 and to prevent the cover plate from being lifted by the airstream as the car is transported over the rails. It will be noted that the plate does not remain adjacent the outer face of strut 25 throughout operation of the hitch. As shown in FIG. 4, the plates moves away from the strut as it is raised and lowered; however, as shown in FIGS. 2 and 5, when the hitch is fully erect or fully retracted, the plate rests against the strut.

In view of the above, it will be seen that the several objects and features of this invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. A retarder for a railcar hitch, said hitch being movable between an erected position and a retracted position, said retarder controlling movement of the hitch from its erected position to its retracted position, the retarder comprising:

a cylinder fixedly adapted to be mounted on a railcar;

a piston movable in the cylinder;

means for attaching the piston to said hitch so substantially only axial loads are placed on the piston during movement of the hitch from its erected to its retracted position; and, means for controlling the compression of fluid in the cylinder by the piston to control the rate of movement of the hitch as the hitch moves from its erected position toward its retracted position.

2. The retarder of claim 1 further including a rod coupled to said piston and extending through one end of said cylinder.

3. The retarder of claim 2 further including bearing means positioned at said one end of the cylinder for slidingly supporting said rod.

4. The retarder of claim 3 wherein the bearing means includes a cap fitting over said one end of the cylinder through which the rod extends, said cap having a longitudinal central bore the diameter of which corresponds to the diameter of the rod so as to permit sliding motion of said rod with respect to said bearing.

5. The retarder of claim 2 wherein a portion of said hitch is horizontally translatable in axial direction relative to said railcar and said attaching means includes means connected to the other end of the rod for engagement with said hitch portion.

6. The retarder of claim 5 wherein said hitch portion comprises parallel plates joined together by a pin extending transversely to the rod and wherein said attaching means comprising a hook engageable with said pin.

7. The retarder of claim wherein said hook is generally U-shaped and includes a rib extending axially with respect to said rod, said rib being in contact with said pin such that load between said retarder and said hitch are axial loads on said rod.

8. The retarder of claim 7 wherein the rib includes an opening in said hook for receiving a gag bar which is inserted in said opening during maintenance of the hitch to prevent retraction of the hitch.

9. The retarder of claim 1 wherein the fluid compressed in the cylinder is air, and wherein the piston and cylinder comprises expansible chamber means, said control means having means for bleeding compressed fluid from said expansible chamber means at a predetermined rate thereby to said rod has a passageway therein, and wherein said fluid bleeding comprises a first bleed hole in said piston providing communication between expansible chamber means and said rod passageway and a second control the retraction time of the hitch.

10. The retarder of claim 9 wherein said fluid bleeding means comprises at least one bleed hole in said piston for bleeding compressed fluid from said expansible chamber means at a predetermined rate such that upon movement of said hitch from its erected position to its retracted position, fluid compressed in said expansible chamber means counteracts at least in part movement of said hitch from its erected position to its retracted position such that movement of said hitch to its retracted position is retarded.

11. The retarder of claim 10 wherein the size of said fluid bleed means is such as to retard movement of said hitch from its erected position to its retracted position between about 3 and 9 seconds.

12. The retarder of claim 10, wherein the size of said fluid bleed means is such as to retard movement of said hitch from its erected to its retracted position at least 3 seconds.

13. The retarder of claim 3 wherein the piston comprises a wear bearing.

14. The retarder of claim 13 further including a circumferential fluid seal carried by said piston at the end of said wear bearing remote from said rod forming a fluid seal between the piston and the inner wall of the cylinder.

15. The retarder of claim 14 further including a wiping seal attached to the piston at the end of the wear bearing adjacent the rod for wiping the inner wall of the cylinder as the piston moves therethrough.

16. The retarder of claim 1 further including support means for the cylinder at each end thereof.

17. The retarder of claim 16 further including a cap fitting over one end of the cylinder and having a boss on its outer face bearing against the support means at that end of the cylinder.

18. The retarder of claim 1 wherein said cylinder is formed of extruded material, and wherein the inner bore of said cylinder within which said piston is sealed is an extruded surface.

19. A retarder for a railcar hitch, the latter having an erected position and a retracted position, said retarder controlling retraction of the hitch to its retracted position, said hitch having a movable element one end of which is horizontally translatable relative to said railcar as the hitch is moved between its erected and retracted positions, the retarder comprising:

a cylinder fixedly mounted to said railcar;

a piston movable in the cylinder;

means including a hook and a hollow rod for attaching the piston to the movable hitch element so that substantially only axial loads are placed on said piston during operation of the hitch, said hook being connected to said movable element with one end of the rod being attached to the piston and with the other end of the rod being attached to the hook; and, means for controlling the compression of fluid in the cylinder by the piston to regulate the rate of retraction of the hitch, said control means including bleed hole means in the piston thereby to meter the release of fluid compressed in said cylinder by said piston as said hitch moves toward its retracted position whereby during initial retraction of the hitch, air constituting said fluid is compressed in one end of the cylinder until sufficient pressure acts on the piston to substantially counter-balance the weight of the hitch acting on said piston via said rod with the retardation of movement of said hitch to its retracted position being a function of the time required for the compressed air to bleed from said cylinder through the bleed holes.

20. A retarder for a railroad hitch, said hitch being movable between an erected position and a retracted position, said retarder controlling movement of the hitch from its erected to its retracted position, the retarder comprising:

a cylinder fixedly adapted to be mounted on a railcar;

a piston movable in the cylinder;

a rod coupled to said piston and extending through one end of said cylinder;

means for attaching the piston to said hitch so substantially only axial loads are placed on the piston during movement of the hitch from its erected to its retracted position, the hitch having a parallel plates portion horizontally translatable in an axial direction relative to said railcar, the plates being joined together by a pin extending transversely to the rod and the attaching means comprising a hook connected to the other end of the rod and engageable with said pin, said hook being generated U-shpaed and including a rib extending axially with respect to the rod, said rib being in contact with said pin such that the load between said retarder and said hitch are axial loads on said rod; and means for controlling the compression of fluid in the cylinder by the piston to control the rate of movement of the hitch as the hitch moves from its erected position toward its retracted position.

21. The retarder of claim 20 wherein the rib includes an opening in said hook for receiving a gag bar which in inserted in said opening during maintenance of the hitch to prevent retraction of the hitch.

* * * * *